US012616315B2

(12) United States Patent
Williams

(10) Patent No.: US 12,616,315 B2
(45) Date of Patent: May 5, 2026

(54) PORTABLE CHANGING TABLE DEVICE

(71) Applicant: Elaina Williams, Houston, TX (US)

(72) Inventor: Elaina Williams, Houston, TX (US)

( * ) Notice: Subject to any disclaimer, the term of this patent is extended or adjusted under 35 U.S.C. 154(b) by 199 days.

(21) Appl. No.: 18/389,171

(22) Filed: Nov. 13, 2023

(65) Prior Publication Data

US 2025/0151926 A1 May 15, 2025

(51) Int. Cl.
*A47D 5/00* (2006.01)
*A47D 15/00* (2006.01)

(52) U.S. Cl.
CPC ..... *A47D 5/006* (2013.01); *A47D 15/005* (2013.01); *A47D 5/00* (2013.01); *A47D 15/00* (2013.01)

(58) Field of Classification Search
CPC ..... A47D 5/006; A47D 5/00; A47D 15/005; A47D 15/00
USPC ..... 5/655, 657, 652
See application file for complete search history.

(56) References Cited

U.S. PATENT DOCUMENTS 3,462,773 A 8/1969 Triplett
5,265,289 A * 11/1993 Swiger ..... A45F 4/06 5/112
D367,771 S 3/1996 Julian
5,529,270 A * 6/1996 Liu ..... A47C 17/68 248/292.12
6,378,445 B1 * 4/2002 Willard, Sr. ..... A47D 15/008 108/115
6,389,624 B1 * 5/2002 Madole ..... A47D 15/008 5/655
6,581,228 B1 * 6/2003 Boskovich ..... A47D 5/006 5/503.1
7,681,267 B1 3/2010 Hall
10,092,113 B2 10/2018 Longenecker
2006/0225216 A1 10/2006 Thibodeaux
2012/0192355 A1 8/2012 Manzanares
2025/0151926 A1 * 5/2025 Williams ..... A47D 15/005

FOREIGN PATENT DOCUMENTS

GB 2457804 9/2009

* cited by examiner

*Primary Examiner* — Robert G Santos

(57) ABSTRACT

A portable changing table device for folding and porting, allowing a user to transport items within the changing table while folded includes a platform having a base wall and a peripheral wall extending upwardly from the base wall. The platform includes a first section that is pivotably coupled to a second section. The first and second sections pivot together into a folded configuration wherein the peripheral wall on the first section contacts the peripheral wall on the second section. A central hinge pivotably couples the first section to the second section. A plurality of legs is removably coupled to the platform to support the platform above a ground surface. Each leg of the plurality of legs is pivotably coupled to a bottom side of the base wall whereby each of the plurality of legs pivots upwardly toward the bottom side of the base wall.

15 Claims, 7 Drawing Sheets

PORTABLE CHANGING TABLE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to changing tables and more particularly pertains to a new changing table for folding and porting, allowing a user to transport items within the changing table while folded.

(2) Description of Related Art Including Information Disclosed Under 37 CFR 1.97 and 1.98

The prior art relates to changing tables. Parents of infants and toddlers use changing tables regularly. The prior art discloses changing tables for use in a stationary location, such as in the home or in a public restroom. For example, some changing tables for use in the home include padded surfaces so that the table can be used as a crib when the child is napping. Other changing tables have collapsible frames that hold a pad or sheet on which the child is placed while the child is being changed. Portability of infant care accessories is an increasingly important consideration among consumers. When the parent is not at home, it is important to have a safe, clean area to change the diaper of the infant or toddler. Such parents typically carry numerous items with them for the child, including extra diapers, toys, clothes, wipes, bottles, and other accessories. Thus, there is a need in the art for a changing table that can be easily transported, along with all of the other items and accessories, when the parent and child are outside of the home.

BRIEF SUMMARY OF THE INVENTION

An embodiment of the disclosure meets the needs presented above by generally comprising a platform having a base wall and a peripheral wall extending upwardly from the base wall. The base wall has a top side and a bottom side. The platform includes a first section that is pivotably coupled to a second section. The first and second sections pivot together into a folded configuration wherein the peripheral wall on the first section contacts the peripheral wall on the second section. A central hinge pivotably couples the first section to the second section. The central hinge is positioned at a junction between the first section and the second section. A plurality of legs is removably coupled to the platform. The plurality of legs is configured to support the platform above a ground surface. Each leg of the plurality of legs is pivotably coupled to the bottom side of the base wall whereby each of the plurality of legs pivots upwardly toward the bottom side of the base wall.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
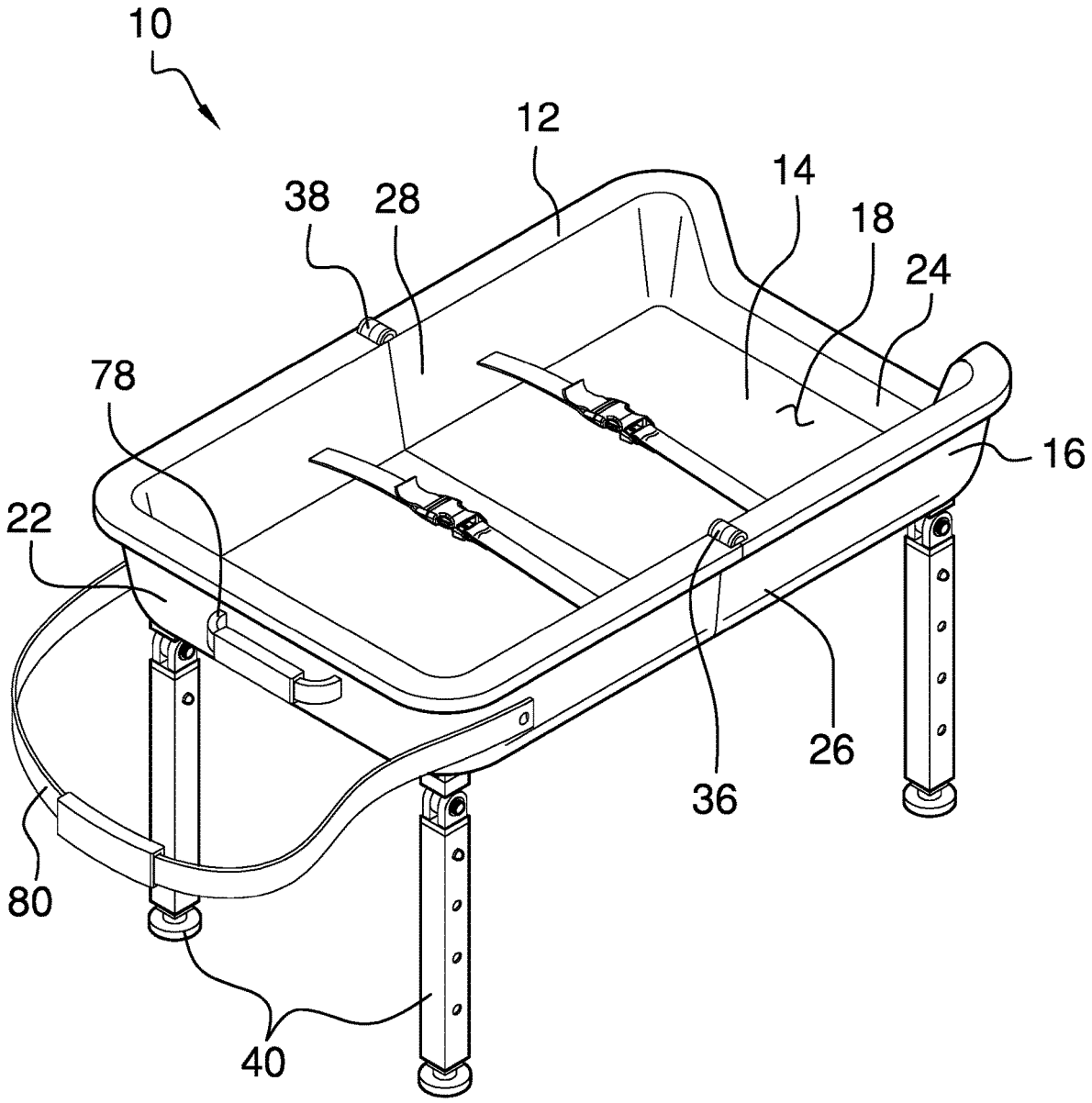
FIG. 1 is an isometric view of a portable changing table device according to an embodiment of the disclosure.
Figure 2:
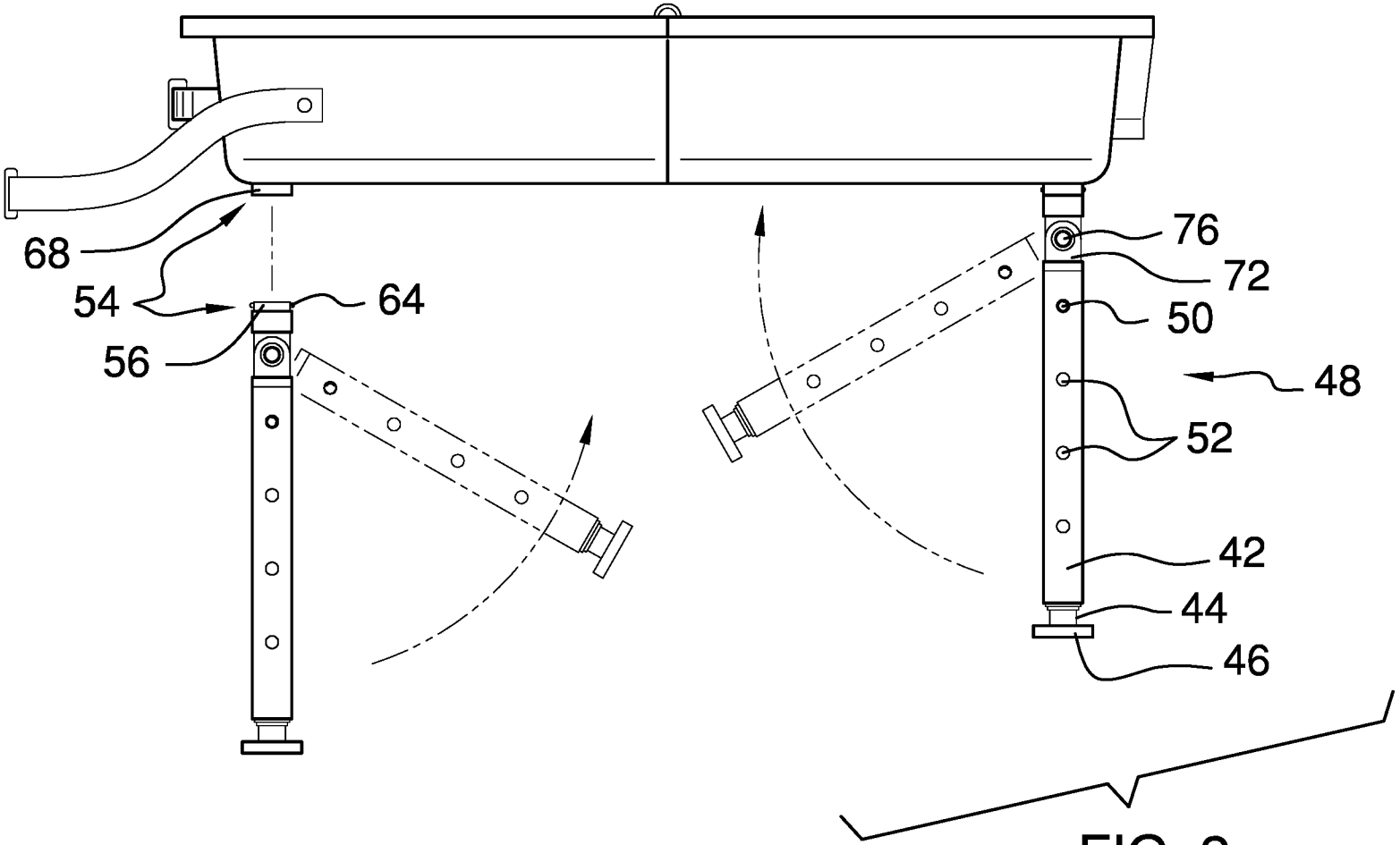
FIG. 2 is a side view of an embodiment of the disclosure.
Figure 3:
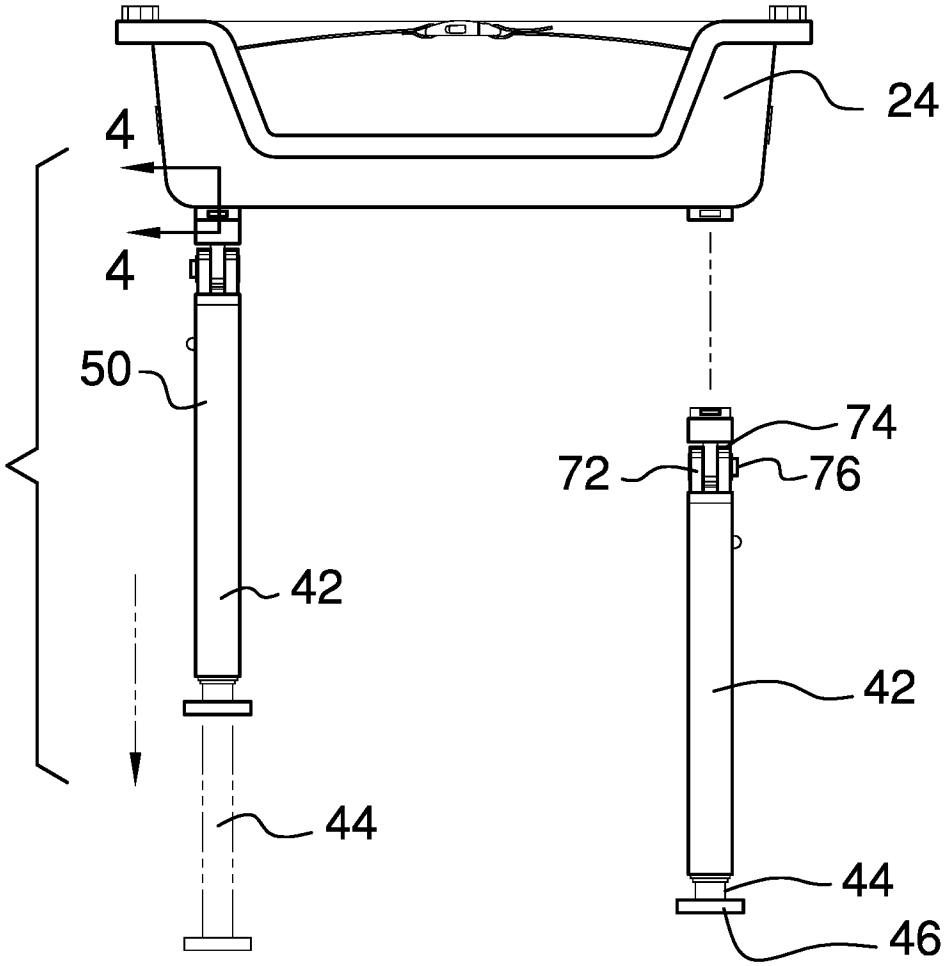
FIG. 3 is a front view of an embodiment of the disclosure.
Figure 4:
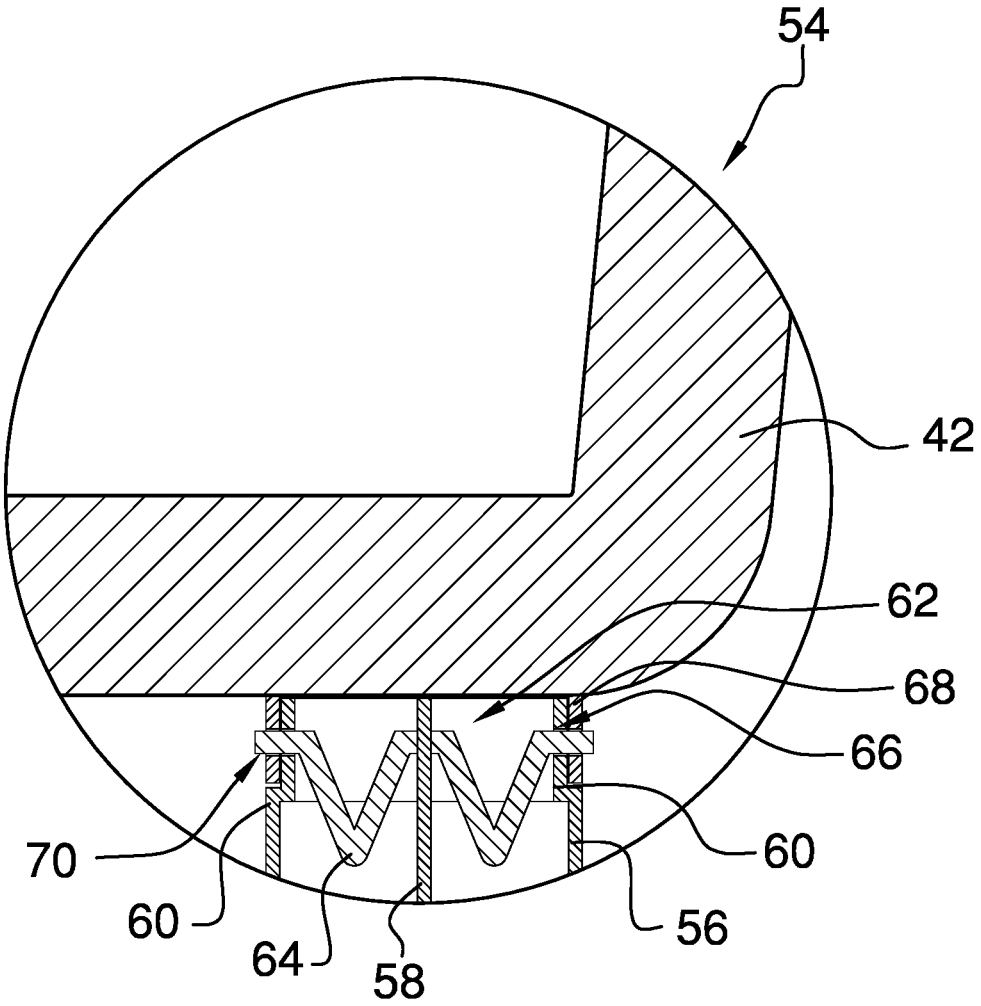
FIG. 4 is a cross-sectional view of an embodiment of the disclosure.

With reference now to the drawings, and in particular to FIGS. 1 through 7 thereof, a new changing table embodying the principles and concepts of an embodiment of the disclosure and generally designated by the reference numeral 10 will be described.

As best illustrated in FIGS. 1 through 7, the portable changing table device 10 generally comprises a platform 12 having a base wall 14 and a peripheral wall 16 extending upwardly from the base wall 14. The base wall 14 has a top side 18 and a bottom side 20. The peripheral wall 16 has a front side 22, a rear side 24, a first lateral side 26, and a second lateral side 28. The platform 12 may have an oval clamshell shape.

The platform 12 generally also includes a first section 30 that is pivotably coupled to a second section 32. The first 30 and second 32 sections pivot together into a folded configuration wherein an upper edge of the peripheral wall 16 on the first section 30 contacts an upper edge of the peripheral wall 16 on the second section 32 to define an interior area. The interior area is configured to provide storage when the platform 12 is in the folded configuration, for example for storage and transport of diapers, wipes, toys, or other items that a user and their child may need.

A central hinge 34 pivotably couples the first section 30 to the second section 32. The central hinge 34 is positioned at a junction between the first section 30 and the second section 34. For example the central hinge 34 may comprise a first hinge portion 36 that is positioned on an upper edge of the first lateral side 26 and a second hinge portion 38 that is positioned on an upper edge of the second lateral side 28.

Figure 5:
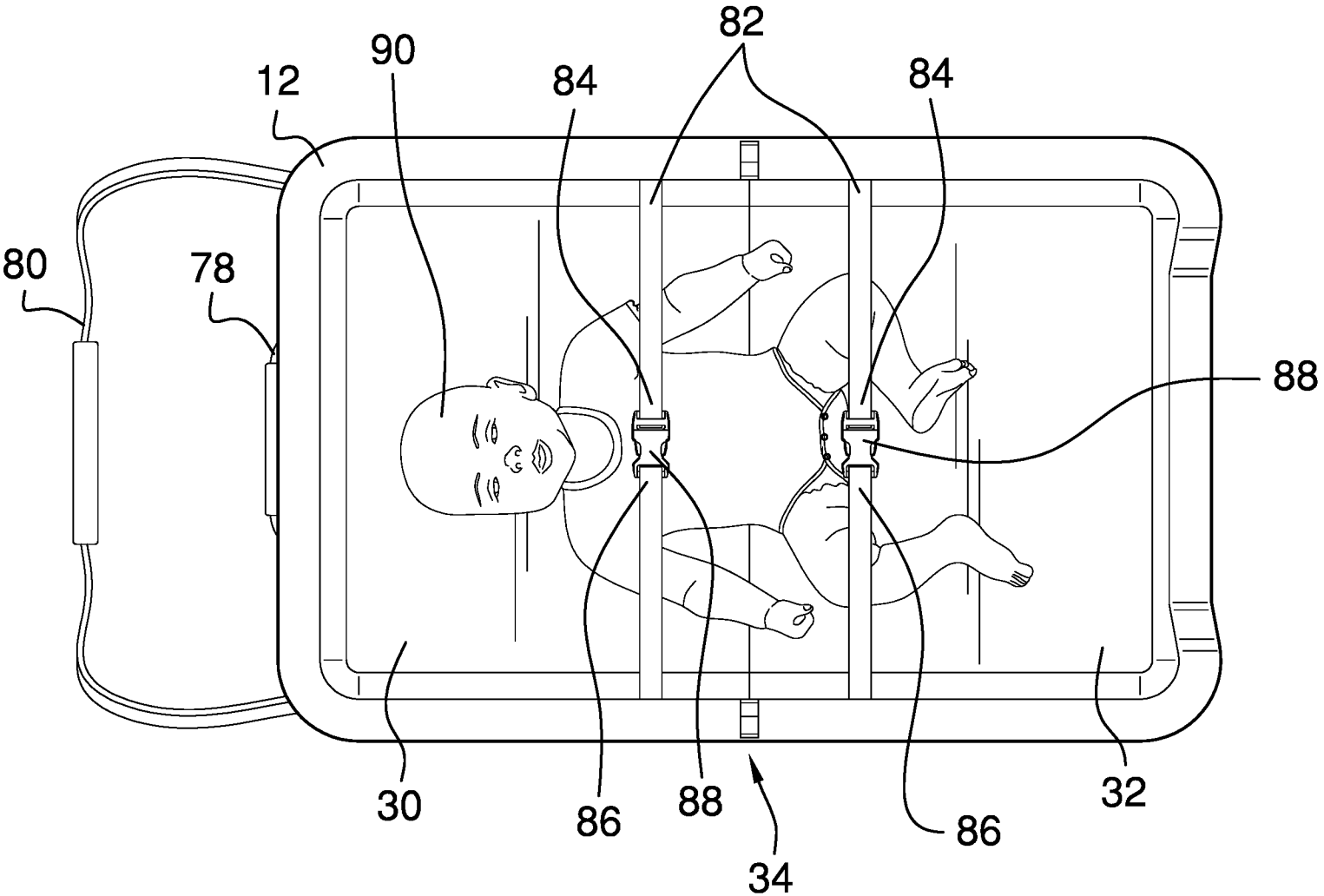
FIG. 5 is a top view of an embodiment of the disclosure.

A plurality of legs 40 are coupled to the platform 12. The plurality of legs 40 is configured to support the platform 12 above a ground surface when a child 90 is resting on the platform 12, as shown in FIG. 5. In some embodiments, two legs of the plurality of legs 40 are coupled to the first section 30 and two legs of the plurality of legs 40 are coupled to the second section 32.

Each leg of the plurality of legs 40 may include a first shaft 42 that is telescopically coupled to a second shaft 44. The second shaft 44 is nested within the first shaft 42 such that the second shaft 44 is extendable relative to the first shaft 42. A foot 46 is coupled to the second shaft 44. The foot 46 is configured to stabilize a respective one of the plurality of legs 40 on the ground surface. A retainer 48 is engaged with the first 42 and second 44 shafts to releasably secure the first 42 and second 44 shafts at a selected position relative to each other. For example, the retainer 48 may comprise a detent 50 mounted on the first shaft 42 and extending through one of a plurality of aligned apertures 52 extending through the second shaft 44.

Each of the plurality of legs 40 may be pivotably coupled to the bottom side 20 of the base wall 14 whereby each of the plurality of legs 40 pivots upwardly toward the bottom side 20 of the base wall 14. Each leg of the plurality of legs 40 may thus include a pair of arms 72 is coupled to a respective one of the plurality of legs 40. The pair of arms 72 may be spaced from each other defining a channel 74. A leg fastener 76 may be coupled to the pair of arms 72 that extends through the channel 74, The pair of arms 72 pivots around the leg fastener 76 whereby the respective one of the plurality of legs 40 pivots upwardly toward the platform 12.

In some embodiments, the plurality of legs 40 may be removably coupled to the platform 12. Such embodiments include a plurality of couplers 54. Each of the plurality of couplers 54 releasably couples an associated one of the plurality of legs 40 to the platform 12.

For example, each of the plurality of couplers 54 may comprise a receiver 56 that is coupled to a top end of each of the plurality of legs 40. The receiver 56 has a first lateral wall 58 and a second lateral wall 60 defining an inner space. A catch 64 is coupled to the receiver 56 and positioned within the inner space 62. The catch 64 is retractable into the inner space 62 of the receiver 56 to release the associated one of the plurality of legs 40 from the platform 12. The receiver 56 has a receiver hole 66 therein. The catch 64 extends through the receiver hole 66 from the inner space 62 to engage the associated one of the plurality of legs 40 with the platform 12. The catch 64 is retractable to be positioned within the inner space 62 and outside the receiver hole 66 whereby the associated one of the plurality of legs 40 is movable relative to the receiver 56. An attachment 68 is configured to releasably engage the receiver 56. The attachment 68 may be coupled to the bottom side 20 of the base wall 14. The attachment 68 has an attachment hole 70 therein. The receiver 56 slidably engages the attachment 68 such that the receiver hole 66 is aligned with the attachment hole 70 when the associated one of the plurality of legs 40 is coupled to the platform 12, the catch 64 extending outwardly from the receiver hole 66 and the attachment hole 70 thereby coupling the associated one of the plurality of legs 40 to the platform 12.

A grip 78 may be coupled to an exterior surface of the peripheral wall 16. The grip 78 is configured to facilitate a user in carrying the platform 12 by hand when the platform 12 is in the folded configuration. The grip 78 may be positioned on the front side 22 of the peripheral wall 16.

A shoulder strap 80 may be coupled to the exterior surface of the peripheral wall 16. The shoulder strap 80 is configured to facilitate the user in carrying the platform 12 over a shoulder when the platform 12 is in the folded configuration. The shoulder strap 80 may be coupled to each of the first 26 and second 28 lateral sides of the peripheral wall 16 and may extend over the front side 22 of the peripheral wall 16.

A safety strap 82 may be coupled to the platform 12. The safety strap 82 extends across the top side 18 of the base wall 14. The safety strap 82 may have a break therein to define a first end 84 and a second end 86. The safety strap 82 may comprise a flexible material. The safety strap 82 may be coupled to an interior surface of the first 26 and second 28 lateral sides of the peripheral wall 16. A strap fastener 88 may be attached to the safety strap 82 that is configured to releasably secure the first end 84 to the second end 86.

Figure 6:
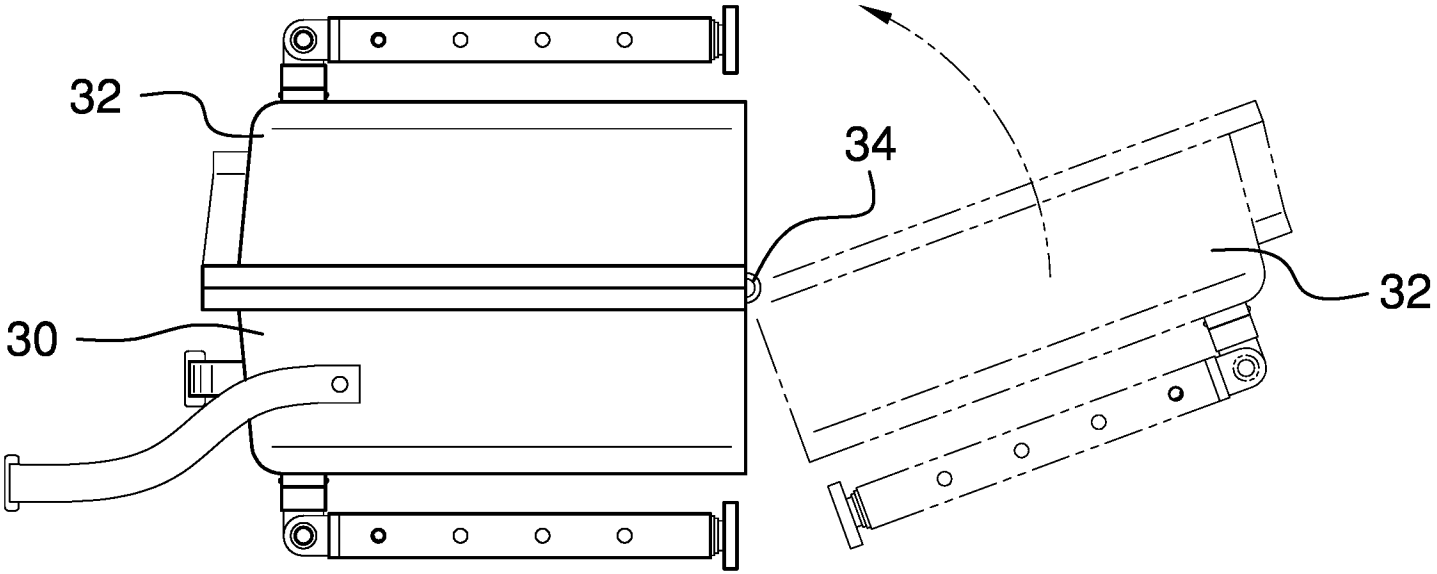
FIG. 6 is an in-use view of an embodiment of the disclosure.
Figure 7:
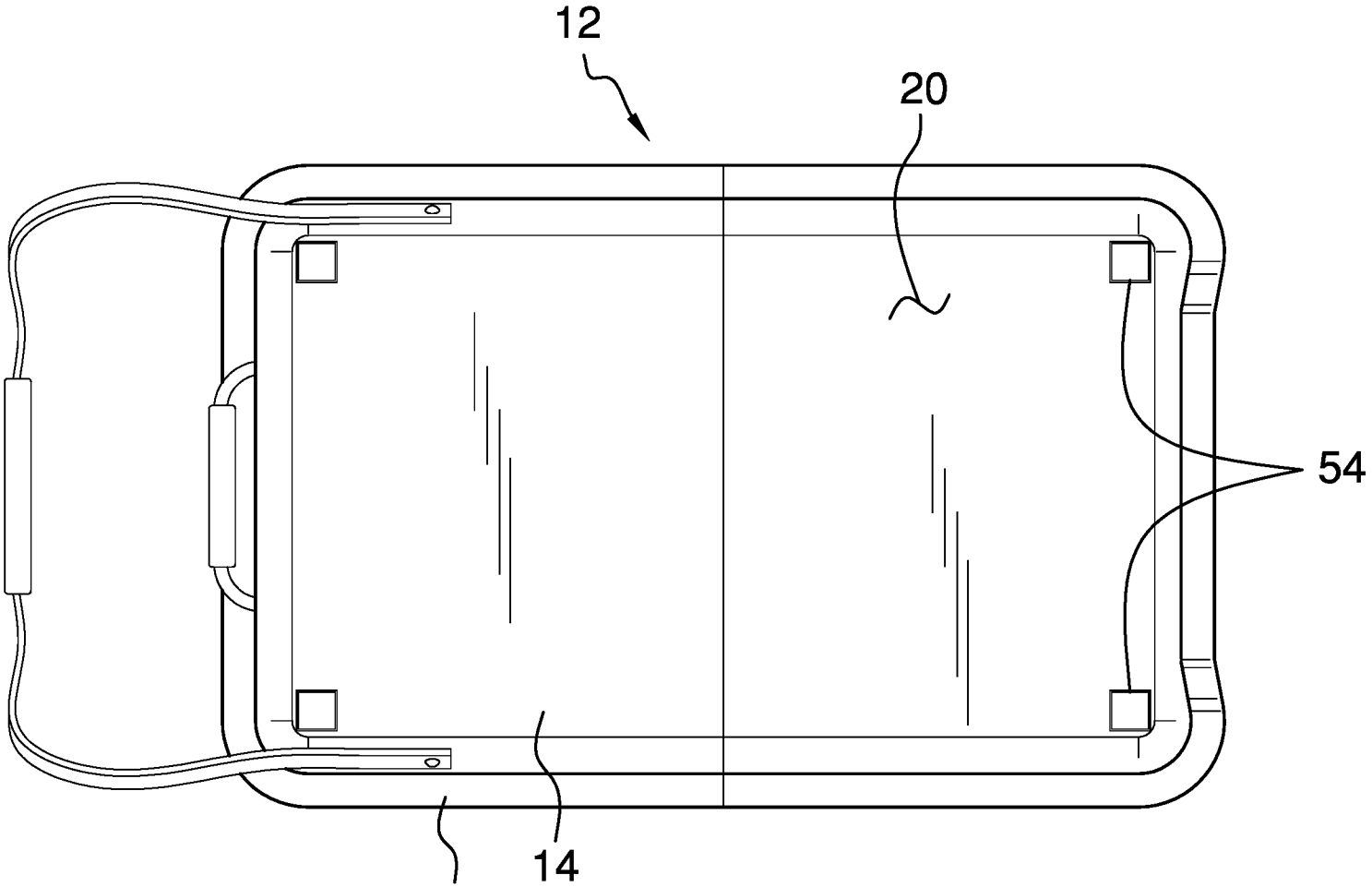
FIG. 7 is a bottom view of an embodiment of the disclosure.

In use, the child 90 can be positioned on the platform 12 and secured with the safety strap 82 for changing. When finished, the child 90 can be removed from the platform 12 by disconnecting the strap fastener 88. The platform 12 can then be folded by pivoting the first 30 and second 32 sections together. This folded configuration is shown in FIG. 6. The plurality of legs 40 can be pivoted toward the bottom side 20 of the base wall 14, as shown in FIG. 6. Alternatively, the plurality of legs 40 may each be disconnected from the platform 12 using the plurality of couplers 54. The plurality of legs 40, or other items such as diapers, toys, or a diaper bag, may be placed in the interior area for transport while the platform 12 is in the folded configuration.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A collapsible changing table assembly comprising:

a platform having a base wall and a peripheral wall extending upwardly from the base wall, the base wall having a top side and a bottom side, the platform including a first section being pivotably coupled to a second section, the first and second sections pivoting together into a folded configuration wherein the peripheral wall on the first section contacts the peripheral wall on the second section;

a central hinge pivotably coupling the first section to the second section, the central hinge being positioned at a junction between the first section and the second section;

a plurality of legs being coupled to the platform, the plurality of legs being configured to support the platform above a ground surface, each leg of the plurality of legs being pivotably coupled to the bottom side of the base wall whereby each of the plurality of legs pivots upwardly toward the bottom side of the base wall; and a plurality of couplers, each of the plurality of couplers releasably coupling an associated one of the plurality of legs with the platform, each of the plurality of couplers further comprising:

a receiver being coupled to a top end of each of the plurality of legs, the receiver having a first lateral wall and a second lateral wall defining an inner space;

a catch being coupled to the receiver and positioned within the inner space, the catch being retractable into the inner space of the receiver to release the associated one of the plurality of legs from the platform;

the receiver having a receiver hole therein, the catch extending through the receiver hole from the inner space to engage the associated one of the plurality of legs with the platform, the catch being retractable to be positioned within the inner space and outside the receiver hole whereby the associated one of the plurality of legs is movable relative to the receiver; and an attachment being configured to releasably engage the receiver, the attachment being coupled to the bottom side of the base wall, the attachment having an attachment hole therein, the receiver slidably engaging the attachment such that the receiver hole is aligned with the attachment hole when the associated one of the plurality of legs is coupled to the platform, the catch extending outwardly from the receiver hole and the attachment hole thereby coupling the associated one of the plurality of legs to the platform.

2. The collapsible changing table assembly of claim 1, wherein the platform has an oval clamshell shape.

3. The collapsible changing table assembly of claim 1, the peripheral wall further comprising a front side, a rear side, a first lateral side, and a second lateral side.

4. The collapsible changing table assembly of claim 3, the central hinge further comprising:

a first hinge portion being positioned on an upper edge of the first lateral side; and a second hinge portion being positioned on an upper edge of the second lateral side.

5. The collapsible changing table assembly of claim 1, each leg of the plurality of legs further comprising:

a first shaft being telescopically coupled to a second shaft, the second shaft being nested within the first shaft such that the second shaft is extendable relative to the first shaft;

a foot being coupled to the second shaft, the foot being configured to stabilize a respective one of the plurality of legs on the ground surface; and a retainer being engaged with the first and second shafts to releasably secure the first and second shafts at a selected position relative to each other.

6. The collapsible changing table assembly of claim 5, the retainer further comprising a detent mounted on the first shaft and extending through one of a plurality of aligned apertures extending through the second shaft.

7. The collapsible changing table assembly of claim 1, each leg of the plurality of legs further comprising:

a pair of arms being coupled to a respective one of the plurality of legs, the pair of arms being spaced from each other defining a channel; and a leg fastener being coupled to the pair of arms and extending through the channel, the pair of arms pivoting around the leg fastener whereby the respective one of the plurality of legs pivots upwardly toward the platform.

8. The collapsible changing table assembly of claim 1, wherein two legs of the plurality of legs are couplable to the first section and two legs of the plurality of legs are couplable to the second section.

9. The collapsible changing table assembly of claim 1, further comprising a grip being coupled to an exterior surface of the peripheral wall, the grip being configured to facilitate a user in carrying the platform by hand when the platform is in the folded configuration.

10. The collapsible changing table assembly of claim 1, further comprising a shoulder strap being coupled to the exterior surface of the peripheral wall, the shoulder strap being configured to facilitate a user in carrying the platform over a shoulder when the platform is in the folded configuration.

11. The collapsible changing table assembly of claim 1, further comprising a safety strap being coupled to the platform, the safety strap extending across the top side of the base wall.

12. The collapsible changing table assembly of claim 11, the safety strap further comprising a flexible material.

13. The collapsible changing table assembly of claim 11, wherein the safety strap has a break therein to define a first end and a second end.

14. The collapsible changing table assembly of claim 13, further comprising a strap fastener being attached to the safety strap and being configured to releasably secure the first end to the second end.

15. A collapsible changing table assembly comprising:

a platform having a base wall and a peripheral wall extending upwardly from the base wall, the base wall having a top side and a bottom side, the peripheral wall having a front side, a rear side, a first lateral side, and a second lateral side, the platform having an oval clamshell shape, the platform including:

a first section being pivotably coupled to a second section, the first and second sections pivoting together into a folded configuration wherein the peripheral wall on the first section contacts the peripheral wall on the second section to define an interior area;

a central hinge pivotably coupling the first section to the second section, the central hinge being positioned at a junction between the first section and the second section, the central hinge comprising:

a first hinge portion being positioned on an upper edge of the first lateral side;

a second hinge portion being positioned on an upper edge of the second lateral side;

a plurality of legs being removably coupled to the platform, the plurality of legs being configured to support the platform above a ground surface, each leg of the plurality of legs comprising:

a first shaft being telescopically coupled to a second shaft, the second shaft being nested within the first shaft such that the second shaft is extendable relative to the first shaft;

a foot being coupled to the second shaft, the foot being configured to stabilize a respective one of the plurality of legs on the ground surface;

a retainer being engaged with the first and second shafts to releasably secure the first and second shafts at a selected position relative to each other, the retainer comprising:

a detent mounted on the first shaft and extending through one of a plurality of aligned apertures extending through the second shaft;

each of the plurality of legs being pivotably coupled to the bottom side of the base wall whereby each of the plurality of legs pivots upwardly toward the bottom side of the base wall, each leg of the plurality of legs including:

a pair of arms being coupled to a respective one of the plurality of legs, the pair of arms being spaced from each other defining a channel;

a leg fastener being coupled to the pair of arms and extending through the channel, the pair of arms pivoting around the leg fastener whereby the respective one of the plurality of legs pivots upwardly toward the platform;

wherein two legs of the plurality of legs are couplable to the first section and two legs of the plurality of legs are couplable to the second section;

a plurality of couplers, each of the plurality of couplers releasably coupling an associated one of the plurality of legs with the platform, each of the plurality of couplers comprising:

a receiver being coupled to a top end of each of the plurality of legs, the receiver having a first lateral wall and a second lateral wall defining an inner space;

a catch being coupled to the receiver and positioned within the inner space, the catch being retractable into the inner space of the receiver to release the associated one of the plurality of legs from the platform;

the receiver having a receiver hole therein, the catch extending through the receiver hole from the inner space to engage the associated one of the plurality of legs with the platform, the catch being retractable to be positioned within the inner space and outside the receiver hole whereby the associated one of the plurality of legs is movable relative to the receiver;

an attachment being configured to releasably engage the receiver, the attachment being coupled to the bottom side of the base wall, the attachment having an attachment hole therein, the receiver slidably engaging the attachment such that the receiver hole is aligned with the attachment hole when the associated one of the plurality of legs is coupled to the platform, the catch extending outwardly from the receiver hole and the attachment hole thereby coupling the associated one of the plurality of legs to the platform;

a grip being coupled to an exterior surface of the peripheral wall, the grip being configured to facilitate a user in carrying the platform by hand when the platform is in the folded configuration, the grip being positioned on the front side of the peripheral wall;

a shoulder strap being coupled to the exterior surface of the peripheral wall, the shoulder strap being configured to facilitate the user in carrying the platform over a shoulder when the platform is in the folded configuration, the shoulder strap being coupled to each of the first and second lateral sides of the peripheral wall and extending over the front side of the peripheral wall;

a safety strap being coupled to the platform, the safety strap extending across the top side of the base wall, the safety strap having a break therein to define a first end and a second end, the safety strap comprising a flexible material, the safety strap being coupled to an interior surface of the first and second lateral sides of the peripheral wall; and a strap fastener being attached to the safety strap and being configured to releasably secure the first end to the second end.

* * * * *